United States Patent [19]

Marshall

[11] Patent Number: 4,936,751

[45] Date of Patent: Jun. 26, 1990

[54] UNIVERSAL FAN BLADE MOUNT

[76] Inventor: John C. Marshall, 11712-B Florida Blvd., Baton Rouge, La. 70815

[21] Appl. No.: 386,150

[22] Filed: Jul. 28, 1989

[51] Int. Cl.[5] ..... F01D 5/00; F01D 7/00

[52] U.S. Cl. ..... 416/246; 403/98; 416/205

[58] Field of Search ..... 416/5, 210 R, 246 R, 416/207, 170 C, 205, 206, 208, 209; 403/92, 98, 375, 353

[56] References Cited

U.S. PATENT DOCUMENTS

| | | | |
|---|---|---|---|
| 238,846 | 3/1881 | Brown | 403/98 |
| 256,614 | 8/1980 | Hoyt | D23/163 |
| 263,498 | 3/1982 | Markowitz | D23/163 |
| 270,563 | 9/1983 | Phillips | D23/158 |
| 271,134 | 10/1983 | Yung | D23/163 |
| 587,245 | 7/1897 | Stellner | 416/207 |
| 888,635 | 5/1908 | Morris | 403/98 |
| 1,031,415 | 7/1912 | Boutwell | 416/207 |
| 1,382,836 | 6/1921 | Juelson . | |
| 1,583,864 | 5/1926 | Tucker | 416/5 |
| 1,604,757 | 10/1926 | Reed | 416/204 |
| 1,799,519 | 4/1931 | Laube | 403/98 |
| 3,300,123 | 1/1967 | Freyholdt et al. | 416/207 X |
| 4,035,093 | 7/1977 | Redshaw | 416/207 X |
| 4,139,330 | 2/1979 | Neal | 416/87 |
| 4,456,382 | 6/1984 | Mahler, II | 366/276 |
| 4,511,310 | 4/1985 | Pearce | 416/134 R |
| 4,634,341 | 1/1987 | Monroe | 416/207 X |

FOREIGN PATENT DOCUMENTS

| | | | |
|---|---|---|---|
| 101292 | 6/1983 | Japan | 416/5 |
| 2069622 | 8/1981 | United Kingdom | 416/5 |
| 2149013 | 6/1985 | United Kingdom | 416/5 |
| 2172936 | 10/1986 | United Kingdom | 416/214 R |

*Primary Examiner*—Robert E. Garrett
*Assistant Examiner*—Hoang Nguyen
*Attorney, Agent, or Firm*—Shlesinger & Myers

[57] ABSTRACT

A universal fan blade mounting assembly including an elongated bar having flanges at each end. One of the flanges is shaped to cooperate with one end of a fan blade and the other flange is constructed for attachment to a ceiling fan rotor. The rotor connecting flange includes two holes therein one of the holes is round for encircling a fastening screw. The other hole forms an arcuate slot. The hole and slot cooperate such that the elongated bar extends outwardly from the center of the rotor such that the functional relationship between the fan blade and the rotor may be maintained.

8 Claims, 1 Drawing Sheet

FIG. 1
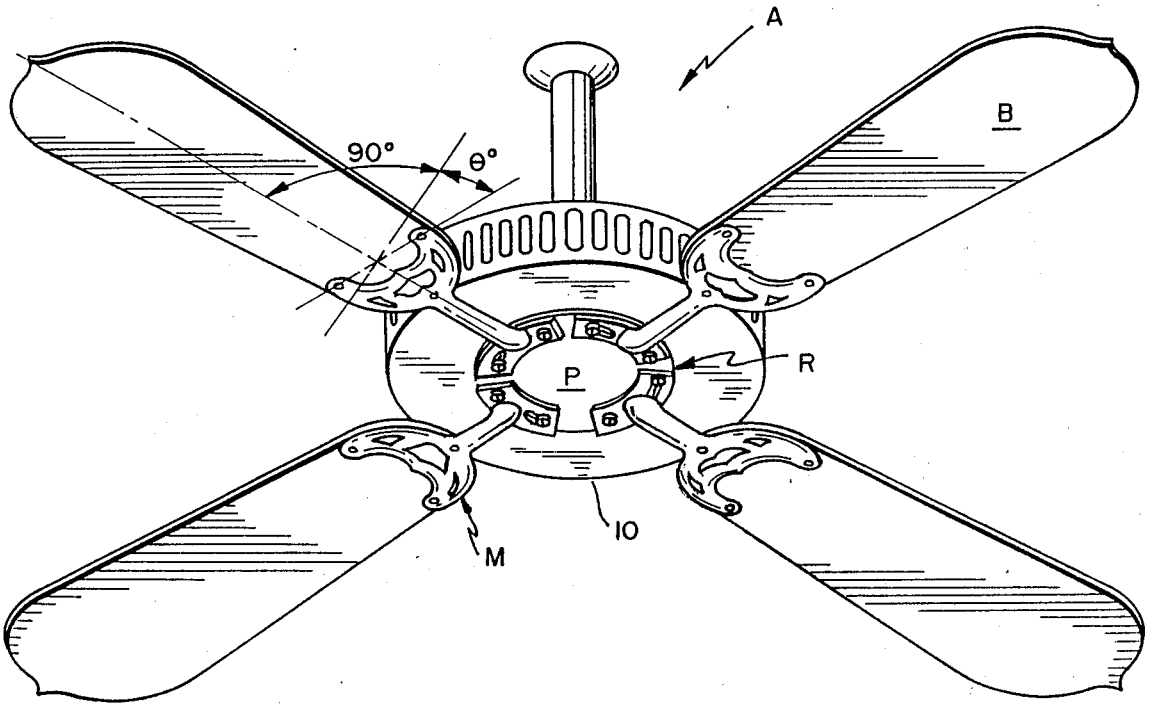
FIG. 4
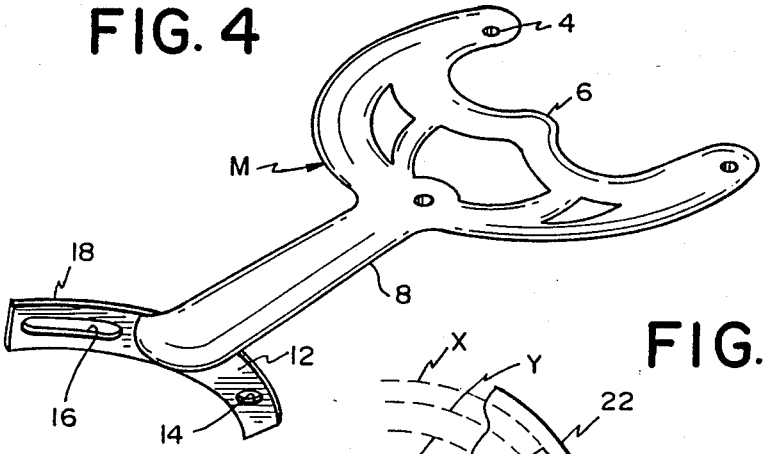
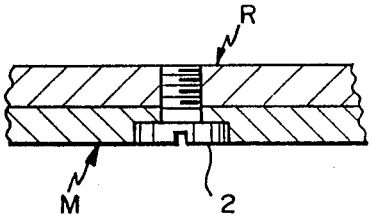
FIG. 2
FIG. 5
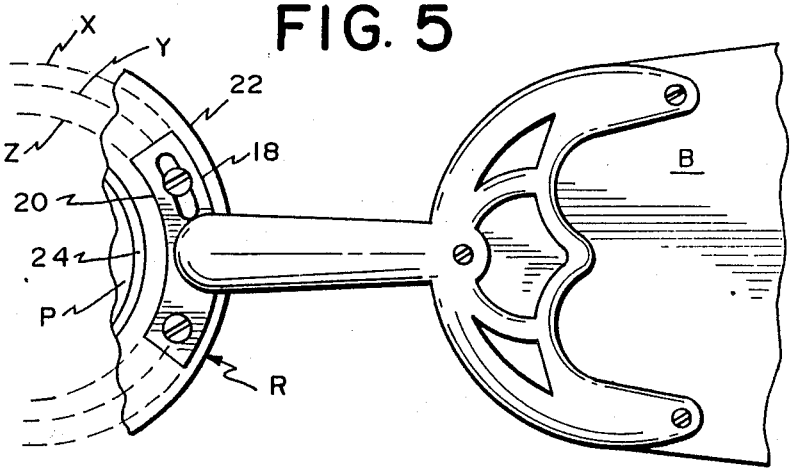
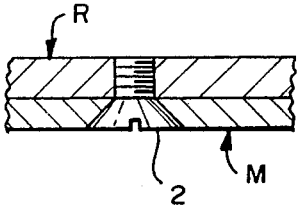
FIG. 3

UNIVERSAL FAN BLADE MOUNT

FIELD OF THE INVENTION

This invention relates to a fan blade mount which is characterized by a body portion having connection flanges at each end to connect the body portion to a fan blade and a ceiling fan rotor. The rotor connection flange includes an adjustment portion which allows the mount to be connected to rotors having differing fastener spacing.

BACKGROUND OF THE INVENTION

Ceiling fans are very popular for facilitating air circulation in homes and businesses. As a result, various manufacturers construct and market ceiling fans to the public. Many of these manufacturers design their own models and subsequently, fan blades are constructed in a plurality of lengths, rotors are available in a variety of diameters, and the mounts are manufactured to join fan blades to specific rotors. Unfortunately, it is an all too common occurrence that the mount is damaged either through stresses caused by repeated start-ups of the rotor or by the fan blade coming in contact with another object and causing bending or breaking of the fan blade mount. In order to replace a broken fan blade mount, it was necessary to contact the manufacturer of the fan to order replacement parts. However, the manufacturer may no longer be in business or as is more often the case is not manufacturing that particular model and their new fan blade mounts are no longer compatible with the older model. Even if the new mounts are available, it may take several weeks to receive them.

In view of the above, it can be seen that there is a need for a universal fan blade mount which can attach a fan blade to any conventional rotor, regardless of the spacing of the attachment holes on the rotor.

OBJECTS AND SUMMARY OF THE INVENTION

The primary object of the disclosed invention is to provide a fan blade mount which can be attached to any conventional rotor regardless of the spacing between the rotor mounting holes.

Another object of the present invention is to provide a fan blade mount which is economical to manufacture.

Another object of the invention is to provide a fan blade mount which can be used as a replacement part on all varieties of ceiling fans.

In summary, therefore, this invention is directed to a fan blade mount for a ceiling fan. The mount includes a fan blade attaching flange at one end and a rotor attaching flange at its other end. The rotor attaching flange is formed into an arcuate shape and includes an arcuate slot for connecting the flange to the rotor.

These and other objects of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings wherein:

FIG. 1 is a perspective view of a conventional ceiling fan;

FIG. 2 and FIG. 3 are fragmentary cross sectional views of fastener head recesses in the mount;

FIG. 4 is a perspective view of the ceiling fan mount;

FIG. 5 is a top plan fragmentary view of the ceiling fan mount attached at one end to a fan blade of indeterminant length and at the other end to a rotor.

DESCRIPTION OF THE INVENTION

Ceiling fan assembly A, as best shown in FIG. 1, includes several fan blades B having generally flat surfaces. Blades B are secured to assembly A by fan blade mounting members M. Mounting members M are generally constructed of metal such as brass, steel or aluminum which may be polished or painted to provide an attractive appearance. Other generally rigid materials such as plastics may also be used to construct the mounting members M. Mounting members M are attached to rotor R by fasteners 2 such as screws or bolts. Rotor R encircles and rotates around a fixed circular plate P as found on many conventional ceiling fans.

The mounting member M, as best shown in FIG. 4, includes plurality of fastener receiving holes 4 for securing the blade attaching flange 6 to fan blade B. Preferably, holes 4 are about ¼" in diameter with a shoulder hole of about 7/16" in diameter. Blade attaching flange 6 is preferably formed in a decorative shape and extends across the entire end of blade B to permit fasteners 2 which extend into holes 4 to be widely spaced apart to secure blade B to mount M. Extending from the blade attaching flange 6 is a body portion 8 of a preferably generally rounded shape. It is to be understood that a flat shape could also be used for the body portion 8 as long as the body portion is of a length so that the blade B will be held extended from the rotor and preferably outside the perimeter of rotor housing 10. Rotor attaching flange 12 is formed at the other end of the elongated body portion 8. Flange 12 is formed in an arcuate flattened shape extending arcuately outwardly on either side of elongated body portion 8. Flange 12 includes a hole 14, preferably, of about ¼" in diameter with a shoulder of about 7/16" in diameter for receiving a fastener on one side of elongated body portion 8 and includes an elongated arcuate slot 16, preferably, of about ¼" in width and having a shoulder width of about 7/16" for receiving a fastener on the other side of elongated body portion 8.

It is the combination of the arcuate flange 12 and the arcuate slot 16 which provides the universal attachment feature of the preferred embodiment. Arcuate slot 16 allows adjustment of mount M such that mount M is adaptable to a variety of rotors. The arcuate shape of the flange 12 and slot 16 permits the mount M to extend radially from rotor R regardless of the spacing of fastener 2 in slot 16. It is of utmost importance that blade B extend radially from rotor R to ensure proper air flow and to maintain balance of the fan blades and ceiling fan assembly. The unique design of one adjustable slot and one non-adjustable hole in the connection between rotor R and fan blade mount M ensures correct alignment of blades B relative to each other. It is foreseeable that a double slot flange could be used instead of the one hole-one slot design, but that approach could create alignment problems between the fan blades and misalignment causes undesirable vibration which could lead to shortened life span of the rotor and blade mounts. It is further foreseeable that a non-arcuate slot could be substituted for slot 16. A straight slot could cause mount M to be angled relative to a radial line extending from the center of the rotor R.

As best shown in FIG. 5, front edge 18 of flange 12 forms an arc, and an extension of the arc is represented by curved dashed line X. The center line Y of hole 14 and slot 16 forms a circular arc which is concentric to dashed line X. Rear edge 20 of flange 12 also forms an arc, the extension of which is shown by curved dashed line Z. When mounts M are mounted on rotor R curved dashed lines X and Z are concentric with center line Y and rotor edges 22 and 24. Preferably, the curvature of center line Y is based on a rotor hole pattern diameter of 5½".

FIG. 5 further shows the fan blade mount attached to a fan blade B by suitable fasteners 2 such as bolts or screws. Fan blade mount M is shown to be attached to a rotor R by similar fasteners 2. Blade attaching flange 4 and rotor attaching flange 12 may lie in the same plane or may lie in parallel planes spaced vertically. Preferably flange 4 and flange 12 lie in planes which are angled relative to each other so that fan blades B are angled slightly relative to their plane of travel so that an air flow may be created either up or down depending on the direction the blades B are turned by rotor R. The preferred angle of pitch 0 between flange 6 and flange 12 is about 12 .

In FIGS. 2 and 3, preferred embodiments of fasteners 2 are shown. In FIG. 2, mount M includes a recess for a threaded fastener 2 having a straight sided head. FIG. 3 shows a recess in the mount for a threaded fastener having an angled head. While the mounting holes 4 and 14, and slot 16 have been described as having preferred diameters and width, respectively, it is to be understood that modifications may be made to those and other features of the invention and are within the scope of the invention.

The mount M is primarily intended to be used as a replacement for damaged or broken original mounts and may be provided in combination with blades. Usually, a set of four mounts and four blades will be provided to ensure proper spacing between all the blades and to provide a matched appearance. The new mounts and blades are easily installed by simply removing the original broker mount by unscrewing the fasteners 2 and then simply installing the new mount and blade using the sam fasteners and inserting the fasteners in the same holes and tightening the fasteners to ensure that the replacement mounts M are securely fastened.

While this invention has been described as having a preferred embodiment, it is understood that it is capable of further modification, uses and/or adaptations of the invention which follow in general the principle of the invention and includes such departures from the present disclosure as come within known or customary practice in the art to which the invention pertains, and as may be applied to the central features herein before set forth, and fall within the scope of the invention or the limits of the appended claims.

What is claimed is:

1. A universal fan blade mount for connecting a fan blade to a fan blade rotor, the fan blade rotor having a pair of fixed position fastening means spaced equal distance from the center of the rotor and being on the same circumference relative to the center of the rotor, the fan blade mount comprising:

(a) a body portion;

(b) said body portion including a first end and a second end;

(c) said second end including means for connecting said second end to a fan blade;

(d) said first end including means for connecting said first end to a fixed position fastening means on the fan blade rotor;

(e) said means for connecting said first end to the fixed position fastening means on the rotor including adjustment means;

(f) said adjustment means permits positioning said mount on a plurality of fan blade rotors, each having fastening means, wherein the spacing of the fastening means varies from a first rotor to a second rotor.

2. The universal fan mount of claim 1, wherein:

(a) said adjustment means for connecting said first end to the rotor includes a flange; and, (b) said flange includes a hole and a slot therein.

3. The universal fan mount of claim 2, wherein: said slot is of an elongated arcuate shape.

4. The universal fan mount of claim 1, wherein:

(a) said adjustment means includes a flange;

(b) said flange is of an arcuate shape;

(c) said flange having a hole and a slot therein;

(d) said hole is sized to receive and encircle a fastening means;

(e) said slot forms an elongated arcuate shape and is sized to receive a fastening means; and, (f) said hole and said slot cooperate with the fastening means to retain said body portion to the rotor so that the fan blade extends outwardly in a radial direction from the rotor.

5. The universal fan mount of claim 4 wherein:

(a) said means for connecting said second end to a fan blade includes a second flange portion;

(b) said second flange portion includes at least one hole therein for reception of fastening means to secure said flange to the fan blade.

6. The universal fan mount of claim 5, wherein:

(a) said means for connecting said first end to a rotor defines a first plane;

(b) said second flange defines a second plane; and, (c) said first plane is angled relative to said second

7. A ceiling fan assembly comprising:

(a) rotor housing means;

(b) rotor means rotatably connected to said rotor housing means including a blade support means;

(c) said blade support means having a circular surface;

(d) said circular surface having an outer edge;

(e) a plurality of fan blades;

(f) mounting means connecting said fan blades to said blade support means;

(g) said mounting means including a first end connected to said rotor means;

(h) said mounting means including a flange at said first end connected to said rotor means;

(i) said flange includes an arcuate edge;

(j) said flange includes a hole therein sized to receive a fastener for connecting said flange to said blade support means;

(k) said flange further includes an arcuate slot sized to receive a fastener for connecting said flange to said blade support means; and, (l) said slot being concentric with the outer edge of said blade support means.

8. The ceiling fan assembly of claim 7, wherein:

(a) said mounting means includes a second end;

(b) said second end having a flange portion; and (c) said flange portion is connected to one of said fan blades for securing the blade to said blade support means.

* * * * *